US006769864B2

(12) United States Patent
Sathianathan et al.

(10) Patent No.: US 6,769,864 B2
(45) Date of Patent: Aug. 3, 2004

(54) GAS TURBINE ENGINE BLADE CONTAINMENT ASSEMBLY

(75) Inventors: Sivasubramaniam K Sathianathan, Burton on Trent (GB); Stephen J Booth, Derby (GB); Ian G Martindale, Derby (GB)

(73) Assignee: Rolls-Royce plc, London (GB)

( * ) Notice: Subject to any disclaimer, the term of this patent is extended or adjusted under 35 U.S.C. 154(b) by 156 days.

(21) Appl. No.: 10/098,590

(22) Filed: Mar. 18, 2002

(65) Prior Publication Data

US 2002/0164244 A1 Nov. 7, 2002

(30) Foreign Application Priority Data

Mar. 30, 2001 (GB) ..... 0107970

(51) Int. Cl.[7] ..... F01D 21/00
(52) U.S. Cl. ..... 415/9; 415/200
(58) Field of Search ..... 415/9, 119, 200, 415/196

(56) References Cited

U.S. PATENT DOCUMENTS 4,452,563 A * 6/1984 Belanger et al. ..... 415/9
4,534,698 A * 8/1985 Tomich ..... 415/9
4,648,795 A * 3/1987 Lardellier ..... 415/196
5,267,828 A * 12/1993 Lenhart et al. ..... 415/9
5,413,456 A * 5/1995 Kulak et al. ..... 415/9
5,486,086 A * 1/1996 Bellia et al. ..... 415/9
6,149,380 A 11/2000 Kuzniar

* cited by examiner

*Primary Examiner*—Edward K. Look
*Assistant Examiner*—Igor Kershteyn
(74) *Attorney, Agent, or Firm*—W. Warren Taltavull; Manelli, Denison & Selter PLLC

(57) ABSTRACT

A gas turbine engine fan blade containment assembly (38) comprising a generally cylindrical, or frustoconical, metal casing (40) has an upstream portion (56), a transition portion (58) and a blade containment portion (54) and a downstream portion (60). The upstream portion (56) has a flange (42) connecting the metal casing (40) to a flange (48) on axially adjacent casing (46). The blade containment portion (54) has a greater thickness ($T_2$) than the thickness ($T_1$) of the upstream portion (54) and the downstream portion (60). The downstream portion (60) has impact protection means (64) located on its inner surface (62) to protect the downstream portion (60) of the containment casing (40). The impact protection means (64) comprises a plurality of radially inwardly and circumferentially extending ribs (80) on the inner surface (62) of the downstream portion (60) to act as spacer between an inner portion of a detached fan blade (34) and the downstream portion (60).

23 Claims, 4 Drawing Sheets

44
52
50
30
40
38
80
72
60
64B
80
74
24
76
80
T4
62
T2
55
54
Y
34
T3
58
56
42
T1
46
48

44
52
50
30
40
38
68
80
72
60
66
70
76
64C
74
66
68
24
80
76
66
68
80
T4
62
T2
55
54
Y
34
T3
58
56
42
T1
46
48

24
30
34
38
40
42
44
46
48
50
52
54
55
56
58
60
62
64D
72
74
76
90
92B
92C
94
98
T1
T2
T3
T4
Y

GAS TURBINE ENGINE BLADE CONTAINMENT ASSEMBLY

FIELD OF THE INVENTION

The present invention relates to gas turbine engine casings, particularly gas turbine engine fan casings, more particularly to an improved blade containment assembly for use within or forming a part of the gas turbine engine casing.

BACKGROUND OF THE INVENTION

Turbofan gas turbine engines for powering aircraft conventionally comprise a core engine, which drives a fan. The fan comprises a number of radially extending fan blades mounted on a fan rotor which is enclosed by a generally cylindrical, or frustoconical, fan casing. The core engine comprises one or more turbines, each one of which comprises a number of radially extending turbine blades enclosed by a cylindrical, or frustoconical, casing.

There is a remote possibility that with such engines that part, or all, of a fan blade, or a turbine blade, could become detached from the remainder of the fan or turbine. In the case of a fan blade becoming detached this may occur as the result of, for example, the turbofan gas turbine engine ingesting a bird or other foreign object.

The use of containment rings for turbofan gas turbine engine casings is well known. It is known to provide generally cylindrical, or frustoconical, relatively thick metallic containment rings. It is also known to provide generally cylindrical, or frustoconical, locally thickened, isogrid, metallic containment rings. Furthermore it is known to provide strong fibrous material wound around relatively thin metallic casings or around the above mentioned containment casings. In the event that a blade becomes detached it passes through the casing and is contained by the fibrous material.

In the event that a blade becomes detached, the metal casing is subjected to two significant impacts. The first impact occurs generally in the plane of the rotor blade assembly as a result of the release of the radially outer portion of the rotor blade. The second impact occurs downstream of the plane of the rotor blade assembly as a result of the radially inner portion of the rotor blade being projected in a downstream direction by the following rotor blade.

SUMMARY OF THE INVENTION

Accordingly the present invention seeks to provide a novel gas turbine engine casing which reduces damage and/or penetration of the gas turbine engine casing downstream of the plane of the rotor blade assembly.

Accordingly the present invention provides a gas turbine engine rotor blade containment assembly comprising a generally cylindrical, or frustoconical, containment casing, the containment casing having an upstream portion, a blade containment portion and a downstream portion, the blade containment portion being downstream of the upstream portion and upstream of the downstream portion, the downstream portion having impact protection means located on its inner surface to protect the downstream portion.

The impact protection means may comprise at least one rib extending circumferentially and radially inwardly from the downstream portion of the containment casing. The impact protection means may comprise a plurality of ribs extending circumferentially and radially inwardly from the downstream portion of the containment casing and the ribs being axially spaced.

The impact protection means may comprise a stiff and lightweight material arranged within and abutting the downstream portion of the containment casing. The stiff and lightweight material may be bonded to the downstream portion of the containment casing.

The stiff and lightweight material may abut the downstream portion of the containment casing axially between the ribs.

The impact protection means may comprise a liner arranged within and abutting the downstream portion of the containment casing. The liner may comprise a plurality of ribs extending radially inwardly, the ribs extending circumferentially and/or axially. The liner may comprise a stiff and lightweight material between the ribs. The liner may be bonded to the downstream portion of the containment casing.

The stiff and lightweight material may comprise honeycomb. The stiff and lightweight material may comprise a metal honeycomb and a metal plate abutting the inner surface of the metal honeycomb. The honeycomb may have a dimension of about 3 mm between the parallel walls of the honeycomb and the walls of the honeycomb may have a thickness of about 0.025 mm to 0.1 mm.

The containment portion may have ribs and/or flanges. The thickness of the blade containment portion may be greater than the thickness of the upstream portion and may be greater than the thickness of the downstream portion. One or more continuous layers of a strong fibrous material may be wound around the containment casing.

The containment casing may comprise any suitable metal or metal alloy. Preferably the metal containment casing comprises a steel alloy, aluminium, an aluminium alloy, magnesium, a magnesium alloy, titanium, a titanium alloy, nickel or a nickel alloy.

An acoustic lining may be provided within the containment casing.

The blade containment portion may have a radially inwardly and axially upstream extending flange, the flange being arranged at the upstream end of the blade containment portion.

The containment casing may be a fan containment casing, a compressor containment casing or a turbine containment casing.

DESCRIPTION OF THE DRAWINGS

The present invention will be more fully described by way of example with reference to the accompanying drawings in which:

FIG. 5 is another alternative enlarged cross-sectional view of the fan blade containment assembly shown in FIG. 1.

DETAILED DESCRIPTION OF THE INVENTION

Figure 1:
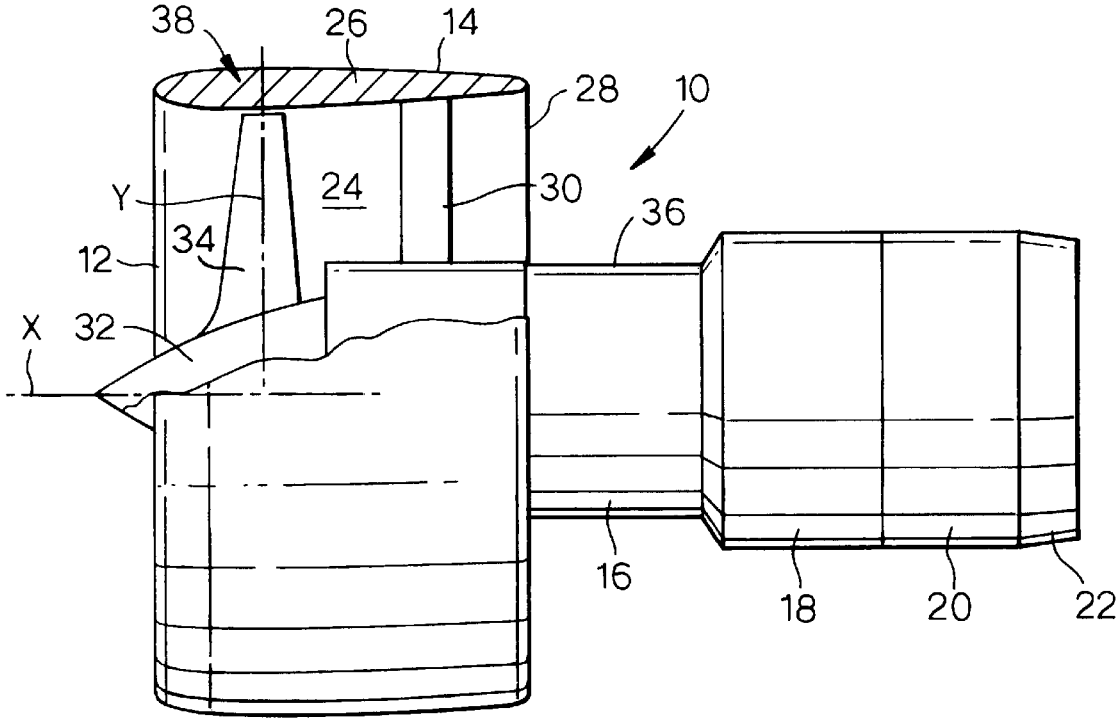
FIG. 1 is a partially cut away view of a gas turbine engine having a fan blade containment assembly according to the present invention.

A turbofan gas turbine engine 10, as shown in FIG. 1, comprises in flow series an intake 12, a fan section 14, a compressor section 16, a combustor section 18, a turbine section 20 and an exhaust 22. The turbine section 20 comprises one or more turbines arranged to drive one or more compressors in the compressor section 16 via shafts (not shown). The turbine section 20 also comprises a turbine to drive the fan section 14 via a shaft (not shown). The fan section 14 comprises a fan duct 24 defined partially by a fan casing 26. The fan duct 24 has an outlet 28 at its axially downstream end. The fan casing 26 is secured to the core engine casing 36 by a plurality of radially extending fan outlet guide vanes 30. The fan casing surrounds a fan rotor 32, which carries a plurality of circumferentially spaced radially extending fan blades 34. The fan rotor 32 and fan blades 34 rotate about the axis X of the gas turbine engine 10, substantially in a plane Y perpendicular to the axis X. The fan casing 26 also comprises a fan blade containment assembly 38, which is arranged substantially in the plane of the fan blades 34.

Figure 2:
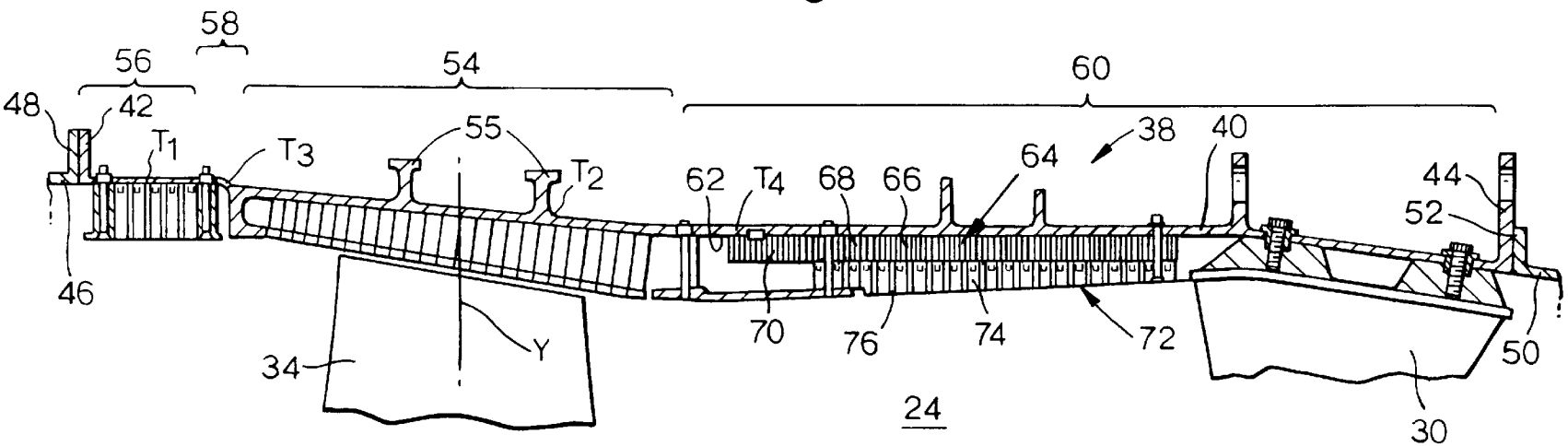
FIG. 2 is an enlarged cross-sectional view of the fan blade containment assembly shown in FIG. 1.

The fan casing 26 and fan blade containment assembly 38 is shown more clearly in FIG. 2. The fan blade containment assembly 38 comprises a metal cylindrical, or frustoconical, casing 40. The metal casing 40 comprises an upstream flange 42 by which the fan blade containment assembly 38 is connected to a flange 48 on an intake assembly 46 of the fan casing 26. The metal casing 40 also comprises a downstream flange 44 by which the fan blade containment assembly 38 is connected to a flange 52 on a rear portion 50 of the fan casing 26.

The metal casing 40 provides the basic fan blade containment and provides a connection between the intake casing 46 and the rear casing 50.

The metal casing 40 comprises an upstream portion 56, a transition portion 58, a main blade containment portion 54 and a downstream portion 60. The upstream portion 56 comprises the flange 42 and the downstream portion 60 comprises the flange 52.

The upstream portion 56 is upstream of the plane Y of the fan blades 34 and provides debris protection for the fan blade containment assembly 38. The main blade containment portion 54 is substantially in the plane Y containing the fan blades 34 and comprises a radially inwardly and axially downstream extending flange, or hook, 63 at its upstream end. The main blade containment portion 54 also comprises one, or more, integral T section ribs 55, which extend radially outwardly from the main blade containment portion 54. The T section ribs 55 extend circumferentially around the main blade containment portion 54 to stiffen the metal casing 40 to improve the fan blade 34 containment properties. The transition portion 58 connects the main blade containment portion 54 and the upstream portion 56 to transmit loads from the main blade containment portion 54 to the upstream flange 42 on the upstream portion 56. The downstream portion 60 is downstream of the plane Y of the fan blades 34, and provides protection for where a root of a fan blade 34 impacts the fan blade containment assembly 38.

The upstream portion 56 of the metal casing 40 has a diameter $D_1$ greater than the diameter $D_2$ of the main blade containment portion 54. The main blade containment portion 54 has a thickness $T_2$ greater than the thickness $T_1$ of the upstream portion 56 of the metal casing 40.

The transition portion 58 has a smoothly curved increase in diameter between the diameter $D_2$ of the main blade containment portion 54 and the diameter $D_1$ of the upstream portion 56. The transition portion 58 has a thickness $T_3$ substantially the same as the thickness $T_1$ of the upstream portion 56. The downstream portion 60 has a thickness $T_4$ less than the thickness $T_2$ of the main blade containment portion 54.

The downstream portion 60 comprises an impact protection means 64 arranged coaxially within and abutting the inner surface 62 of the downstream portion 60. The impact protection means 64 is located in the region of the downstream portion 60 between the main containment portion 54 and the fan outlet guide vanes 30.

The impact protection means 64 comprises a stiff and lightweight material, which is secured to the downstream portion 60. The impact protection means 64 comprises at least one panel 66, but in this example a plurality, fourteen, of circumferentially arranged panels 66 are provided. The panels 66 are arranged to cover the whole circumference of the inner surface 62 of the downstream portion 60. Each panel 66 comprises a high-density corrugated metal honeycomb 68 and a metal sheet 70 secured to the radially inner surface 62 of the corrugated metal honeycomb 68. The corrugated metal honeycomb 68 and the metal sheet 70 comprises aluminium, steel or other suitable metal. The at least one panel 66 is secured to the downstream portion 60 by an epoxy adhesive. The metal sheet 70 is secured to the respective corrugated metal honeycomb 68 by an epoxy adhesive.

However, the at least one panel 66 may be secured to the downstream portion 60 by bonding, brazing, fusing or other suitable means. Each metal sheet 70 may be secured to the respective corrugated metal honeycomb 68 by bonding, brazing, fusing or other suitable means.

An acoustic liner 72 is provided within the downstream portion 60 on the inner surface of the impact protection means 64. The acoustic lining 66 comprises a honeycomb 74 and a perforate sheet 76. The honeycomb 74 and perforate sheet 76 are quite conventional. The acoustic liner 72 also partially defines the outer surface of the fan duct 24.

For example the acoustic liner 72 comprises a honeycomb 74 with a dimension of 12.5 mm between the parallel walls of the honeycomb 74 and the walls of the honeycomb 74 have a thickness of 0.0254 mm. The panel 66 comprises a honeycomb 68 with a dimension of 3 mm between the parallel walls of the honeycomb 68 and the walls of the honeycomb 68 have a thickness of 0.025 mm to 0.1 mm. The honeycomb 68 of the panels 66 thus has a stabilised crush strength of 2000 pounds per square inch to 5000 pounds per square inch ($1.38\times10^7$ Pa to $3.45\times10^7$ Pa). The depth of the honeycomb 68 of the panels 66 is 0.5 to 2.5 inches (12.5 mm to 63 mm). One example is a depth of 17 mm and a crush strength of $2.76\times10^7$ Pa.

In operation of the gas turbine engine 10, in the event that a fan blade 34, a radially outer portion of a fan blade 34 or a radially inner portion of a fan blade 34 becomes detached it encounters the metal casing 40. The main blade containment portion 54 of the metal casing 40 is impacted by the fan blade 34, or radially outer portion of the fan blade 34, and effectively removes energy from the fan blade 34, or radially outer portion of the fan blade 34. The downstream portion 60 of the metal casing 40 is impacted by the radially inner portion of the fan blade 34 and the impact protection means 64 provides protection to the downstream portion 60. The panels 66 of the impact protection means 64 acts as a spacer between the radially inner portion, the root, of the fan blade 34 and the downstream portion 60 of the metal casing 40 to reduce the damage to the downstream portion 60 and to prevent it penetrating through the downstream portion 60. The impact protection means 64 prevents the inner portion of the fan blade 34 contacting the downstream portion 60 of the metal casing 40 and hence prevents the sharp corners, or edges, of the inner portion of the fan blade 34 cutting through the downstream portion 60 of the metal casing 40.

The advantage of the present invention is that it reduces the weight of metal casing and improves the performance of the gas turbine engine. The stiff and lightweight material enables the thickness of the downstream portion to be reduced and hence the weight of the downstream portion.

Figure 3:
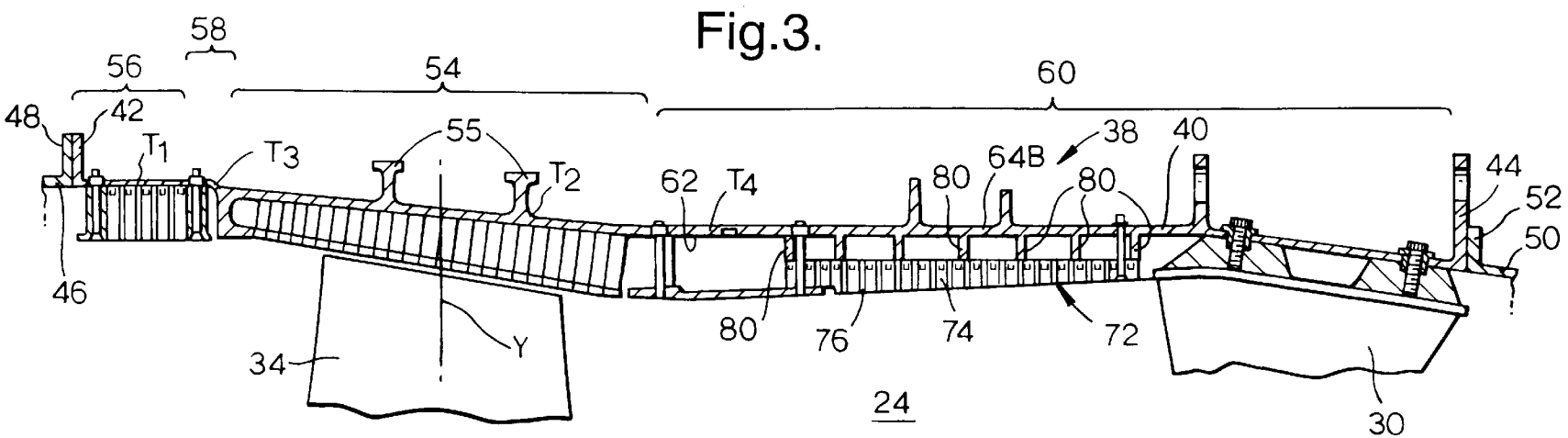
FIG. 3 is an alternative enlarged cross-sectional view of the fan blade containment assembly shown in FIG. 1.

An alternative fan casing 26 and fan blade containment assembly 38 is shown more clearly in FIG. 3. The arrangement is similar to that shown in FIG. 2 and like parts are denoted by like numerals.

The downstream portion 60 comprises an impact protection means 64B arranged coaxially within and abutting the inner surface 62 of the downstream portion 60. The impact protection means 64B is located in the region of the downstream portion 60 between the main containment portion 54 and the fan outlet guide vanes 30.

The impact protection means 64B comprises at least one rib 80, which extends radially inwardly from and circumferentially around the inner surface 62 of the downstream portion 60. In this example a plurality, six, of axially spaced circumferentially extending ribs 80 are provided. The ribs 80 are machined from the downstream portion 60. The radial height, axial thickness and number of the ribs 80 may be varied to optimise the impact protection for the downstream portion 60. The ribs 80 for example may have a radial height of 0.5 to 2.5 inches (12.5 mm to 63 mm). The ribs 80 may also be T shaped in cross-section. The ribs 80 of the impact protection means 64B act as a spacer between the radially inner portion, the root, of the fan blade 34 and the downstream portion 60 of the metal casing 40 to reduce the damage to the downstream portion 60 and to prevent it penetrating through the downstream portion 60. The impact protection means 64B prevents the inner portion of the fan blade 34 contacting the downstream portion 60 of the metal casing 40 and hence prevents the sharp corners, or edges, of the inner portion of the fan blade 34 cutting through the downstream portion 60 of the metal casing 40.

An acoustic liner 72 is provided within the downstream portion 60 on the inner surface of the impact protection means 64B. The acoustic lining 72 comprises a honeycomb 74 and a perforate sheet 76. The honeycomb 74 and perforate sheet 76 are quite conventional. The acoustic liner 72 also partially defines the outer surface of the fan duct 24.

The advantage of this embodiment is that the thickness and weight of the downstream portion is reduced and hence there is a performance benefit for the gas turbine engine. Additionally there are fewer components in the impact protection means.

Figure 4:
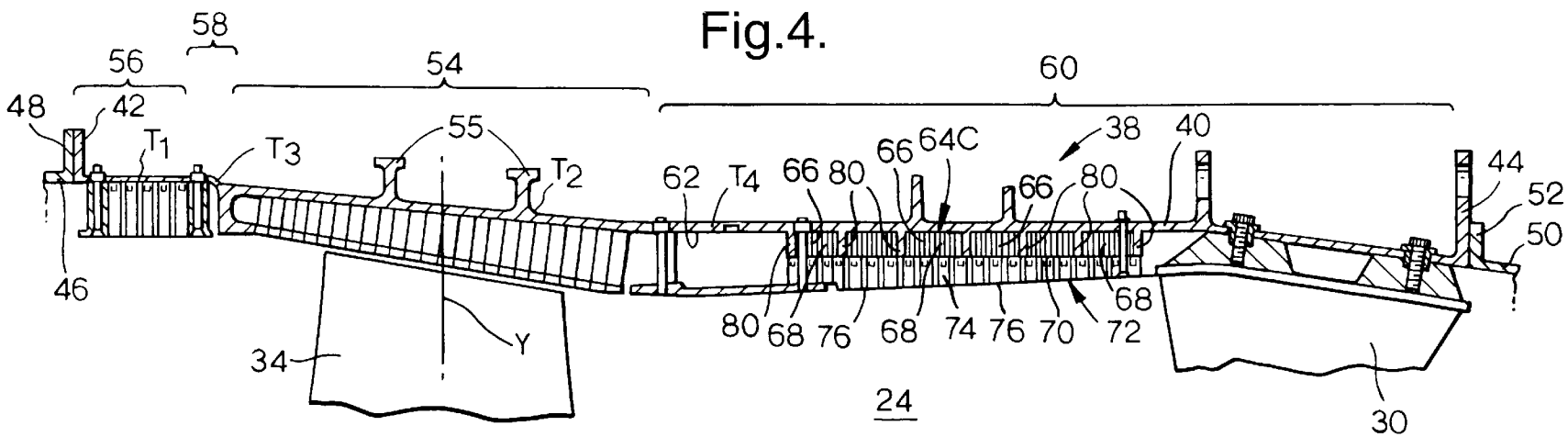
FIG. 4 is a further alternative enlarged cross-sectional view of the fan blade containment assembly shown in FIG. 1.

A further alternative fan casing 26 and fan blade containment assembly 38 is shown more clearly in FIG. 4. The arrangement is similar to those shown in FIGS. 2 and 3 and like parts are denoted by like numerals.

The downstream portion 60 comprises an impact protection means 64C arranged coaxially within and abutting the inner surface 62 of the downstream portion 60. The impact protection means 64C is located in the region of the downstream portion 60 between the main containment portion 54 and the fan outlet guide vanes 30.

The impact protection means 64C comprises a plurality of ribs 80. Each rib 80 extends radially inwardly from and circumferentially around the inner surface 62 of the downstream portion 60. In this example a plurality, six, of axially spaced circumferentially extending ribs 80 are provided. The ribs 80 are machined from the downstream portion 60.

The impact protection means 64C also comprises a stiff and lightweight material secured to the downstream portion 60 axially between each pair of axially spaced circumferentially extending ribs 80. The impact protection means 64C comprises at least one panel 66, but in this example a plurality, fourteen, of circumferentially arranged panels 66 are provided between each pair of axially spaced circumferentially extending ribs 80. The panels 66 are arranged to cover the whole circumference of the inner surface 62 of the downstream portion 60. Each panel 66 comprises a high-density corrugated metal honeycomb 68 and a metal sheet 70 secured to the radially inner surface 62 of the corrugated metal honeycomb 68. The corrugated metal honeycomb 68 and the metal sheet 70 may comprise aluminium, steel or other suitable metal. The at least one panel 66 is secured to the downstream portion 60 by an epoxy adhesive. The metal sheet 70 is secured to the respective corrugated metal honeycomb 68 by an epoxy adhesive.

However, the at least one panel 66 may be secured to the downstream portion 60 by bonding, brazing, fusing or other suitable means. Each metal sheet 70 may be secured to the respective corrugated metal honeycomb 68 by bonding, brazing, fusing or other suitable means.

The ribs 80 and panels 66 of the impact protection means 64C act as a spacer between the radially inner portion, the root, of the fan blade 34 and the downstream portion 60 of the metal casing 40 to reduce the damage to the downstream portion 60 and to prevent it penetrating through the downstream portion 60. The impact protection means 64C prevents the inner portion of the fan blade 34 contacting the downstream portion 60 of the metal casing 40 and hence prevents the sharp corners, or edges, of the inner portion of the fan blade 34 cutting through the downstream portion 60 of the metal casing 40.

An acoustic liner 72 is provided within the downstream portion 60 on the inner surface of the impact protection means 64C. The acoustic liner 72 comprises a honeycomb 74 and a perforate sheet 76. The honeycomb 74 and perforate sheet 76 are quite conventional. The acoustic liner 72 also partially defines the outer surface of the fan duct 24.

For example the acoustic liner 72 comprises a honeycomb 74 with a dimension of 12.5 mm between the parallel walls of the honeycomb 74 and the walls of the honeycomb 74 have a thickness of 0.0254 mm. The panel 66 comprises a honeycomb 68 with a dimension of 3 mm between the parallel walls of the honeycomb 68 and the walls of the honeycomb 68 have a thickness of 0.025 mm to 0.1 mm. The honeycomb 68 of the panels 66 thus has a stabilised crush strength of 2000 pounds per square inch to 5000 pounds per square inch ($1.38\times10^7$ Pa to $3.45\times10^7$ Pa). The depth of the honeycomb 68 of the panels 66 is 0.5 to 2.5 inches (12.5 mm to 63 mm). One example is a depth of 17 mm and a crush strength of $2.76\times10^7$ Pa.

The advantage of this embodiment is that the thickness and weight of the downstream portion is reduced and hence there is a performance benefit for the gas turbine engine. Additionally this embodiment has greater impact protection cue to the combination of the features of the embodiments in FIGS. 2 and 3.

Figures 5A, 5B, 5C, 5D:
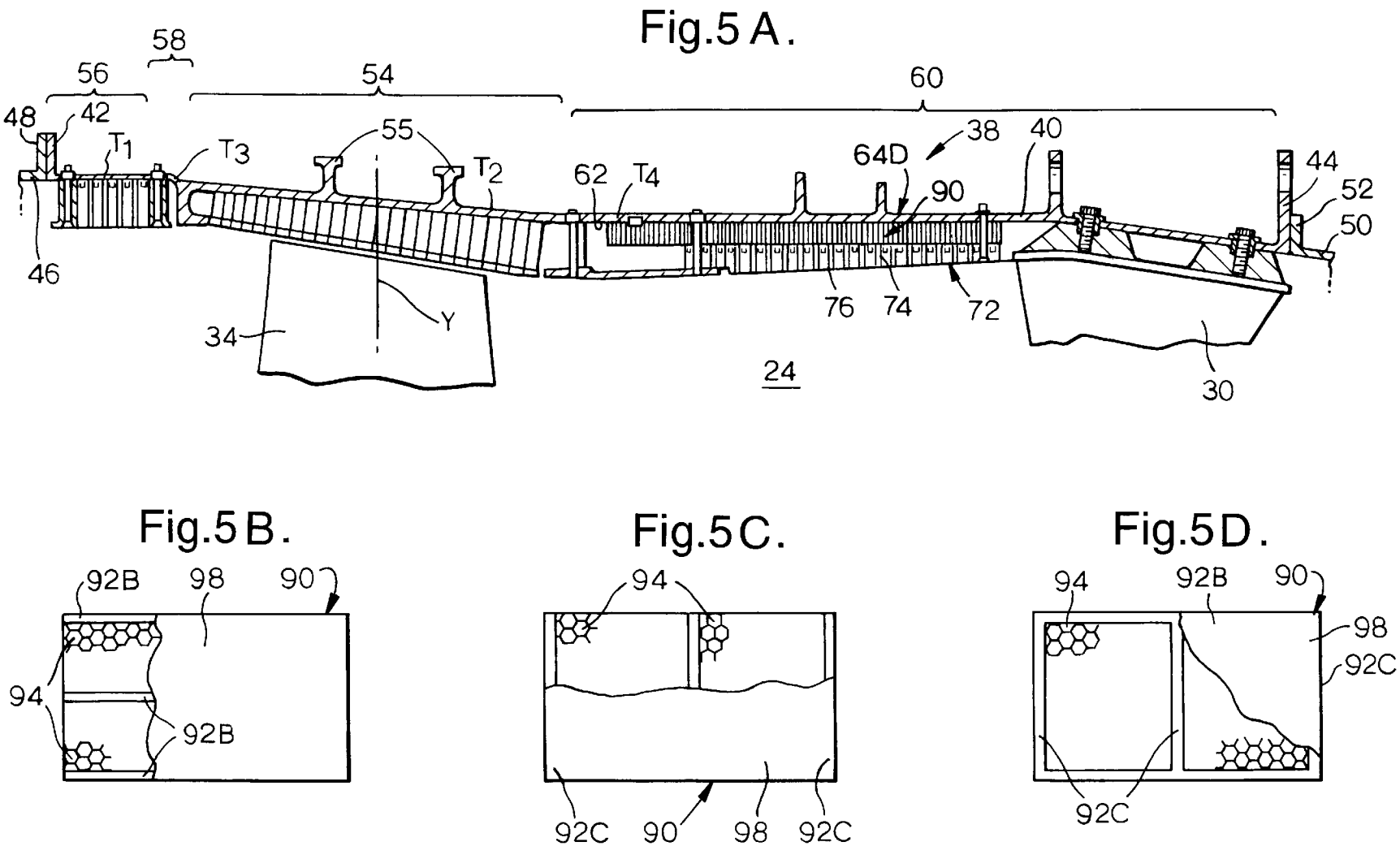
FIGS. 5B, 5C and 5D are plan views of alternative liners for use in FIG. 5.

A further alternative fan casing 26 and fan blade containment assembly 38 is shown more clearly in FIG. 5. The arrangement is similar to that shown in FIG. 2 and like parts are denoted by like numerals.

The downstream portion 60 comprises an impact protection means 64D arranged coaxially within and abutting the inner surface 62 of the downstream portion 60. The impact protection means 64D is located in the region of the downstream portion 60 between the main containment portion 54 and the fan outlet guide vanes 30.

The impact protection means 64D comprises a liner 90 secured to the downstream portion 60. The liner 90 comprises a plurality of ribs 60. Each rib 92 extends radially and each rib 92B extends axially along the inner surface 62 of the downstream portion 60 as in FIG. 5C, each rib 92C extends circumferentially around the inner surface 62 of the downstream portion 60 as in FIG. 5D or some ribs 92B extend axially and some ribs 92C extend circumferentially as in FIG. 5D.

The impact protection means 64D also comprises a stiff and lightweight material secured to the liner 90 axially between each pair of axially spaced circumferentially extending ribs 92B, between each pair of circumferentially spaced axially extending ribs 92C or between axially and circumferentially extending ribs 92B and 92C. The impact protection means 64D comprises at least one panel, but in this example a plurality, fourteen, of circumferentially arranged panels are provided. The panels are arranged to cover the whole circumference of the inner surface 62 of the downstream portion 60. Each panel comprises a high-density corrugated metal honeycomb 94 and a metal sheet 98 secured to the radially inner surface 96 of the corrugated metal honeycomb 94. The ribs 92, the corrugated metal honeycomb 94 and the metal sheet 98 comprises aluminium, steel or other suitable metal. The at least one panel is secured to the downstream portion 60 by an epoxy adhesive. The metal sheet 98 is secured to the respective corrugated metal honeycomb 94 by an epoxy adhesive.

The liner 90 of the impact protection means 64D act as a spacer between the radially inner portion, the root, of the fan blade 34 and the downstream portion 60 of the metal casing 40 to reduce the damage to the downstream portion 60 and to prevent it penetrating through the downstream portion 60. The impact protection means 64D prevents the inner portion of the fan blade 34 contacting the downstream portion 60 of the metal casing 40 and hence prevents the sharp corners, or edges, of the inner portion of the fan blade 34 cutting through the downstream portion 60 of the metal casing 40.

However, the at least one panel 90 may be secured to the downstream portion 60 by bonding, brazing, fusing or other suitable means. Each metal sheet 98 may be secured to the respective corrugated metal honeycomb 94 by bonding, brazing, fusing or other suitable means.

An acoustic liner 72 is provided within the downstream portion 60 on the inner surface of the impact protection means 64D. The acoustic lining 66 comprises a honeycomb 74 and a perforate sheet 76. The honeycomb 74 and perforate sheet 76 are quite conventional. The acoustic liner 72 also partially defines the outer surface of the fan duct 24.

For example the acoustic liner 72 comprises a honeycomb 74 with a dimension of 12.5 mm between the parallel walls of the honeycomb 74 and the walls of the honeycomb 74 have a thickness of 0.0254 mm. The liner 90 comprises a honeycomb 94 with a dimension of 3 mm between the parallel walls of the honeycomb 94 and the walls of the honeycomb 94 have a thickness of 0.025 mm to 0.1 mm. The honeycomb 94 of the panels 90 thus has a stabilised crush strength of 2000 pounds per square inch to 5000 pounds per square inch ($1.38\times10^7$ Pa to $3.45\times10^7$ Pa). The depth of the honeycomb 94 of the panels 90 is 0.5 to 2.5 inches (12.5 =to 63 mm). One example is a depth of 17 mm and a crush strength of $2.76\times10^7$ Pa.

In a further embodiment of the present invention the impact protection means comprises at least one panel arranged to cover the inner surface of the downstream portion. Each panel comprises a high-density corrugated metal honeycomb and a metal sheet secured to the radially inner surface of the corrugated metal honeycomb. In this example the impact protection means liners also acts as an acoustic lining and the depth of the honeycomb of the panels is about 2.5 inches (63 mm). The honeycomb has a crush strength of $1.38\times10^7$ Pa to $3.45\times10^7$ Pa.

Alternatively in a further arrangement the ribs have a radial height of about 2.5 inches (63 mm) and panels are arranged between the ribs. The panels comprise a high density corrugated metal honeycomb and a metal sheet secured to the radially inner surface of the corrugated metal honeycomb. Again the panels act as an acoustic lining and the depth of the honeycomb of the panels is about 2.5 inches (63 mm). The honeycomb has a crush strength of $1.38\times10^7$ Pa to $3.45\times10^7$ Pa.

The metal casing may be manufactured from any suitable metal or metal alloy. Preferably the metal casing comprises a steel alloy, aluminium, an aluminium alloy, magnesium, a magnesium alloy, titanium, a titanium alloy, nickel or a nickel alloy.

Although the invention has been described with reference to a metal casing it may be possible to use the invention on other types of casings.

Although the invention has been described with reference to a metal casing with circumferentially extending ribs it may be possible to use the invention on casings without these ribs.

The invention has been described with reference to a fan blade containment assembly, however it is equally applicable to a compressor blade containment assembly and a turbine blade containment assembly.

What is claimed is:

1. A gas turbine engine rotor blade containment assembly comprising a generally cylindrical, or frustoconical, containment casing, the containment casing having an upstream portion, a blade containment portion and a downstream portion, the blade containment portion being downstream of the upstream portion and upstream of the downstream portion, the downstream portion having impact protection means located on its inner surface to protect the downstream portion of the containment casing wherein the impact protection means comprises a stiff and lightweight material arranged within and abutting the downstream portion of the containment casing.

2. A gas turbine engine rotor blade containment assembly as claimed in claim 1 wherein the stiff and lightweight material is bonded to the downstream portion of the containment casing.

3. A gas turbine engine rotor blade containment assembly comprising a generally cylindrical, or frustoconical, containment casing, the containment casing having an upstream portion, a blade containment portion and a downstream portion, the blade containment portion being downstream of the upstream portion and upstream of the downstream portion, the downstream portion having impact protection means located on its inner surface to protect the downstream portion of the containment casing wherein the impact protection means comprises a liner arranged within and abutting the downstream portion of the containment casing and wherein the liner comprises a plurality of ribs extending radially inwardly, the ribs extending circumferentially and/or axially.

4. A gas turbine engine rotor blade containment assembly as claimed in claim 3 wherein the liner comprises a stiff and lightweight material between the ribs.

5. A gas turbine engine rotor blade containment assembly comprising a generally cylindrical, or frustoconical, containment casing, the containment casing having an upstream portion, a blade containment portion and a downstream portion, the blade containment portion being downstream of the upstream portion and upstream of the downstream portion, the downstream portion having impact protection means located on its inner surface to protect the downstream portion of the containment casing and wherein the impact protection means comprises a liner arranged within and abutting the downstream portion of the containment casing wherein the liner is bonded to the downstream portion of the containment casing.

6. A gas turbine engine rotor blade containment assembly as claimed in claim 1 or claim 3 wherein the stiff and lightweight material comprises honeycomb.

7. A gas turbine engine rotor blade containment assembly as claimed in claim 6 wherein the stiff and lightweight material comprises a metal honeycomb and a metal plate abutting the inner surface of the metal honeycomb.

8. A gas turbine engine rotor blade containment assembly as claimed in claim 6 wherein the honeycomb has a dimension of about 3 mm between the parallel walls of the honeycomb and the walls of the honeycomb have a thickness of about 0.025 mm to 0.1 mm.

9. A gas turbine engine rotor blade containment assembly as claimed in claim 6 wherein the honeycomb has a crush strength of 2000 psi to 5000 psi.

10. A gas turbine engine rotor blade containment assembly as claimed in claim 1 wherein the containment portion has ribs and/or flanges.

11. A gas turbine engine rotor blade containment assembly as claimed in claim 10 wherein the thickness of the blade containment portion being greater than the thickness of the upstream portion and greater than the thickness of the downstream portion.

12. A gas turbine engine rotor blade containment assembly as claimed in claim 1 wherein the containment casing comprises a metal selected from the group consisting of a steel alloy, aluminium, an aluminium alloy, magnesium, a magnesium alloy, titanium, a titanium alloy, nickel and a nickel alloy.

13. A gas turbine engine rotor blade containment assembly as claimed in claim 1 wherein an acoustic lining is provided within the containment casing.

14. A gas turbine engine rotor blade containment assembly comprising a generally cylindrical, or frustoconical, containment casing, the containment casing having an upstream portion, a blade containment portion and a downstream portion, the blade containment portion being downstream of the upstream portion and upstream of the downstream portion, the downstream portion having impact protection means located on its inner surface to protect the downstream portion of the containment casing wherein the blade containment portion has a radially inwardly and axially downstream extending flange, the flange being arranged at the upstream end of the blade containment portion.

15. A gas turbine engine rotor blade containment assembly comprising a generally cylindrical, or frustoconical containment casing, the containment casing having an upstream portion, a blade containment portion and a downstream portion, the blade containment portion being downstream of the upstream portion and upstream of the downstream portion, the downstream portion having impact protection means located on its inner surface to protect the downstream portion of the containment casing, the impact protection means comprises at least one rib extending circumferentially and radially inwardly from the downstream portion of the containment casing.

16. A gas turbine engine rotor blade containment assembly as claimed in claim 15 wherein the impact protection means comprises a plurality of ribs extending circumferentially and radially inwardly from the downstream portion of the containment casing and the ribs being axially spaced.

17. A gas turbine engine rotor blade containment assembly as claimed in claim 16 wherein the impact protection means comprises a stiff and lightweight material arranged within and abutting the downstream portion of the containment casing, the stiff and lightweight material abuts the downstream portion of the containment casing axially between the ribs.

18. A gas turbine engine rotor blade containment assembly as claimed in claim 17 wherein the stiff and lightweight material is bonded to the downstream portion of the containment casing.

19. A gas turbine engine rotor blade containment assembly as claimed in claim 17 wherein the stiff and lightweight material comprises a honeycomb.

20. A gas turbine engine blade containment assembly as claimed in claim 1 wherein the containment casing is one of a fan containment casing, a compressor containment casing or a turbine containment casing.

21. A gas turbine engine rotor blade containment assembly as claimed in claim 19 wherein the stiff and lightweight material comprises a metal honeycomb and a metal plate abutting the inner surface of the metal honeycomb.

22. A gas turbine engine rotor blade containment assembly as claimed in claim 19 wherein the honeycomb has a dimension of about 3 mm between the parallel walls of the honeycomb and the walls of the honeycomb have a thickness of about 0.025 mm to 0.1 mm.

23. A gas turbine engine rotor blade containment assembly as claimed in claim 19 wherein the honeycomb has a crush strength of 2000 psi to 5000 psi.

* * * * *